US007101222B2

(12) United States Patent
Ho et al.

(10) Patent No.: US 7,101,222 B2
(45) Date of Patent: Sep. 5, 2006

(54) MEMORY CARD CONNECTOR ASSEMBLY FOR RECEIVING MULTIPLE MEMORY CARDS

(75) Inventors: Yi-Tse Ho, Tainan Hsien (TW); Tung-Chang Lin, Taipei Hsien (TW); Ching-Chia Chu, Pan Chiao (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/210,323

(22) Filed: Aug. 24, 2005

(65) Prior Publication Data

US 2006/0046567 A1 Mar. 2, 2006

(30) Foreign Application Priority Data

Aug. 27, 2004 (TW) ..... 93213686 U

(51) Int. Cl.
*H01R 13/60* (2006.01)

(52) U.S. Cl. ..... 439/541.5

(58) Field of Classification Search ..... 439/540.1, 439/159, 160, 541.5
See application file for complete search history.

(56) References Cited

U.S. PATENT DOCUMENTS 5,334,046 A * 8/1994 Brouillette et al. ..... 439/541.5
5,364,275 A * 11/1994 Ota et al. ..... 439/65
5,399,105 A * 3/1995 Kaufman et al. ..... 439/609
5,490,791 A * 2/1996 Yamada et al. ..... 439/159
5,490,792 A * 2/1996 Sugita ..... 439/159
5,591,047 A * 1/1997 Yamada et al. ..... 439/541.5
5,601,438 A * 2/1997 Ho et al. ..... 439/64
5,613,860 A * 3/1997 Banakis et al. ..... 439/64
5,636,999 A * 6/1997 Hirai et al. ..... 439/79
5,643,001 A * 7/1997 Kaufman et al. ..... 439/159
5,655,918 A * 8/1997 Soh ..... 439/159
5,688,130 A * 11/1997 Huang ..... 439/79
5,709,568 A * 1/1998 Pan et al. ..... 439/541.5
5,711,679 A * 1/1998 Spickler et al. ..... 439/79
5,713,747 A * 2/1998 Hsia et al. ..... 439/79
5,725,385 A * 3/1998 Takano et al. ..... 439/64
5,775,923 A * 7/1998 Tomioka ..... 439/79
5,795,184 A * 8/1998 Pan et al. ..... 439/541.5
5,906,510 A * 5/1999 Lwee ..... 439/541.5
5,954,522 A * 9/1999 Ho et al. ..... 439/79
5,967,803 A * 10/1999 Ho ..... 439/79
5,975,190 A * 11/1999 Luginbuhl et al. ..... 164/430
6,059,586 A * 5/2000 Watanabe et al. ..... 439/159
6,062,904 A * 5/2000 Oguchi et al. ..... 439/541.5
6,071,149 A * 6/2000 Hara ..... 439/607
6,116,950 A * 9/2000 Koseki ..... 439/541.5
6,120,322 A * 9/2000 Ho et al. ..... 439/541.5
6,129,564 A * 10/2000 Kawamae et al. ..... 439/101
6,132,243 A * 10/2000 Hirata et al. ..... 439/541.5
6,146,193 A * 11/2000 Yu ..... 439/541.5

(Continued)

*Primary Examiner*—Ross Gushi
(74) *Attorney, Agent, or Firm*—Stephen Z. Weiss

(57) ABSTRACT

A memory card connector assembly is provided for mounting on a printed circuit board. The assembly includes a first memory card connector for mounting on the circuit board and including a housing defining a bottom card-receiving space for receiving a first memory card. A plurality of terminals are provided for electrically connecting appropriate contacts on the first memory card to the circuit board. A second memory card connector is provided for mounting over the top of the first connector. The second connector includes a housing defining a top card-receiving space for receiving a second memory card, along with a plurality of terminals for electrically connecting appropriate contacts on the second memory card to the circuit board.

15 Claims, 8 Drawing Sheets

U.S. PATENT DOCUMENTS 6,174,197 B1 * 1/2001 Hirata et al. ..... 439/541.5
6,179,652 B1 * 1/2001 Tung et al. ..... 439/541.5
6,183,273 B1 * 2/2001 Yu et al. ..... 439/92
6,193,547 B1 * 2/2001 Tung ..... 439/541.5
6,231,382 B1 * 5/2001 Yu ..... 439/541.5
6,238,240 B1 * 5/2001 Yu ..... 439/541.5
6,247,969 B1 * 6/2001 Niitsu ..... 439/607
6,261,106 B1 * 7/2001 Tung ..... 439/79
6,287,129 B1 * 9/2001 Kuo ..... 439/79
6,287,143 B1 * 9/2001 Lwee ..... 439/541.5
6,299,455 B1 * 10/2001 Dong ..... 439/59
6,341,964 B1 * 1/2002 Yu ..... 439/79
6,379,163 B1 * 4/2002 Yu ..... 439/95
6,386,909 B1 * 5/2002 Hsia et al. ..... 439/541.5
6,390,832 B1 * 5/2002 Kuo ..... 439/101
6,478,615 B1 * 11/2002 Kuo ..... 439/541.5
6,482,030 B1 * 11/2002 Kuo ..... 439/541.5
6,506,074 B1 * 1/2003 Hashimoto ..... 439/541.5
6,540,552 B1 * 4/2003 Kuo ..... 439/541.5
6,551,131 B1 * 4/2003 Kuo ..... 439/541.5
6,551,132 B1 * 4/2003 Kuo ..... 439/541.5
6,558,192 B1 * 5/2003 Kuo ..... 439/541.5
6,568,957 B1 * 5/2003 Lu et al. ..... 439/541.5
6,600,865 B1 * 7/2003 Hwang ..... 385/134
6,634,905 B1 * 10/2003 Kuo ..... 439/541.5
6,648,680 B1 * 11/2003 Hu ..... 439/541.5
6,666,724 B1 * 12/2003 Lwee ..... 439/630
6,736,671 B1 * 5/2004 Lee ..... 439/541.5
2001/0029127 A1 * 10/2001 Higuchi ..... 439/541.5
2003/0114043 A1 * 6/2003 Kuo ..... 439/541.5
2004/0023553 A1 * 2/2004 Lee ..... 439/541.5
2004/0029438 A1 * 2/2004 Choy ..... 439/541.5
2004/0092159 A1 * 5/2004 Tsai ..... 439/541.5
2005/0118863 A1 * 6/2005 Tanigawa et al. ..... 439/541.5
2005/0142934 A1 * 6/2005 Cheng ..... 439/541.5

* cited by examiner

MEMORY CARD CONNECTOR ASSEMBLY FOR RECEIVING MULTIPLE MEMORY CARDS

FIELD OF THE INVENTION

This invention generally relates to the art of electrical connectors and, particularly, to a memory card connector for mounting on a printed circuit board and for receiving multiple memory cards.

BACKGROUND OF THE INVENTION

Memory cards are known in the art and contain intelligence in the form of a memory circuit or other electronic program. Some form of card reader reads the information or memory stored on the card. Such cards are used in many applications in today's electronic society, including video cameras, digital still cameras, smart phones, PDA's, music players, ATMs, cable television decoders, toys, games, PC adapters, multi-media cards and other electronic applications. Typically, a memory card includes a contact or terminal array for connection through a card connector to a card reader system and then to external equipment. The connector readily accommodates insertion and removal of the card to provide quick access to the information and program on the card. The card connector includes terminals for yieldingly engaging the contact array of the memory card.

The memory card connector often is mounted on a printed circuit board. The memory card, itself, writes or reads via the connector and can transmit between electrical appliances, such as a word processor, personal computer, personal data assistant or the like. With circuit board mounted connectors, the terminals of a connector include tail portions which are connected to appropriate circuit traces on the printed circuit board by various systems, such as surface mount technology wherein the tail portions are reflow soldered to the circuit traces, or through hole technology wherein the tail portions of the terminals are inserted into holes in the printed circuit board for connection, as by soldering, to circuit traces on the board and/or in the holes.

Some memory card connectors are designed for receiving multiple memory cards, such as a pair of stacked cards of different types. The different types of memory cards have different sizes, different shapes and different contact arrays. For many years, a single memory card connector, such as a circuit board mounted connector, was used to receive a single type of memory card. If a different type of memory card was to be used in a particular electronic apparatus, a completely different connector had to be employed. Consequently, connectors have been designed for receiving multiple memory cards of different types. For instance, a single memory card connector may be used for receiving two different types of memory cards in a stacked array. FIG. 1 shows a memory card connector, generally designated 10, according to the prior art. The connector is mounted within a chassis 12 of an electronic apparatus. The connector is mounted on a printed circuit board 14 on a bottom wall 12*a* of the chassis. A front wall 12*b* of the chassis has an opening 12*c* for receiving two different types of memory cards 16 and 18. However, the prior art connector 10 still is limited to two types of memory cards without any further selectiveness. If it is necessary to employ another, third type of memory card, the entire multi-card connector 10 must be changed or replaced. The present invention is directed to solving these problems by providing a memory card connector assembly in which any number of connectors are interchangeable in the assembly to accommodate any number of memory cards.

SUMMARY OF THE INVENTION

An object, therefore, of the invention is to provide a new and improved memory card connector of the character described, particularly a connector assembly for receiving multiple memory cards.

In the exemplary embodiment of the invention, a memory card connector assembly is provided for mounting on a printed circuit board. The assembly includes a first memory card connector for mounting on the circuit board and including housing means defining a bottom card-receiving space for receiving a first memory card. A plurality of terminals are provided for electrically connecting appropriate contacts on the first memory card to the circuit board. A second memory card connector is provided for mounting over the top of the first connector. The second connector includes housing means defining a top card-receiving space for receiving a second memory card, along with a plurality of terminals for electrically connecting appropriate contacts on the second memory card to the circuit board.

Therefore, if a third memory card connector is required in a particular electronic apparatus, only one of the first or second connectors must be replaced while the other connector still can be used. This results in a significant cost savings over the prior art.

According to one aspect of the invention, the first and second memory card connectors include respectively aligned mounting portions for mounting the connectors on the circuit board. These aligned mounting portions can be on the housing means of the respective connectors.

According to another aspect of the invention, the housing means of the first memory card connector includes a metal shielding cover defining the top of the bottom card-receiving space. The metal shielding cover is located to separate the top and bottom card-receiving spaces.

As disclosed herein, both of the first and second connectors include card eject mechanisms. The eject mechanism of each connector is independent of the eject mechanism of the other connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
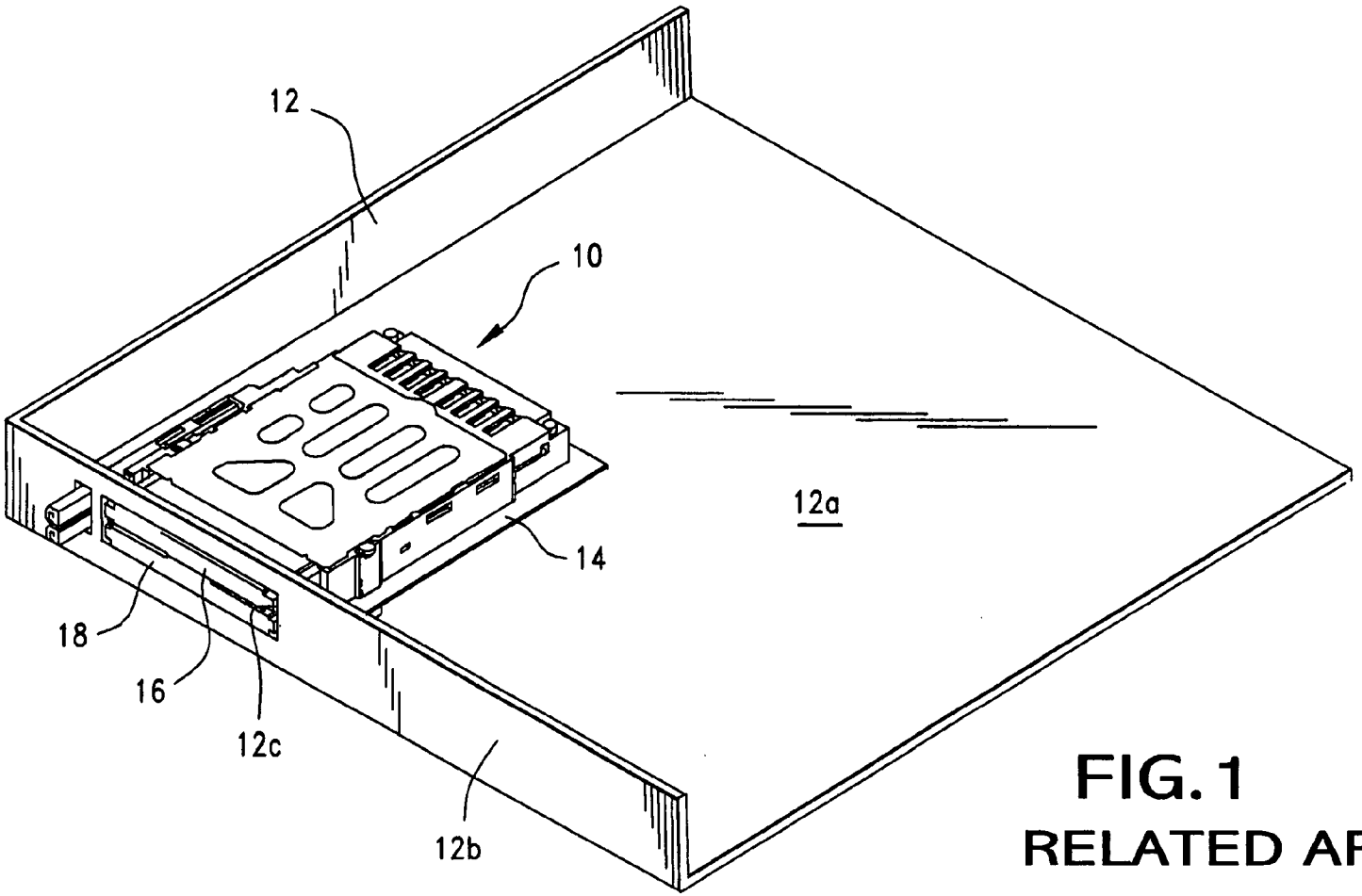
FIG. 1 RELATED ART
FIG. 1 is a top perspective view of a memory card connector according to the prior art, mounted in a chassis of an electronic apparatus and as described in the Background, above.
Figure 2:
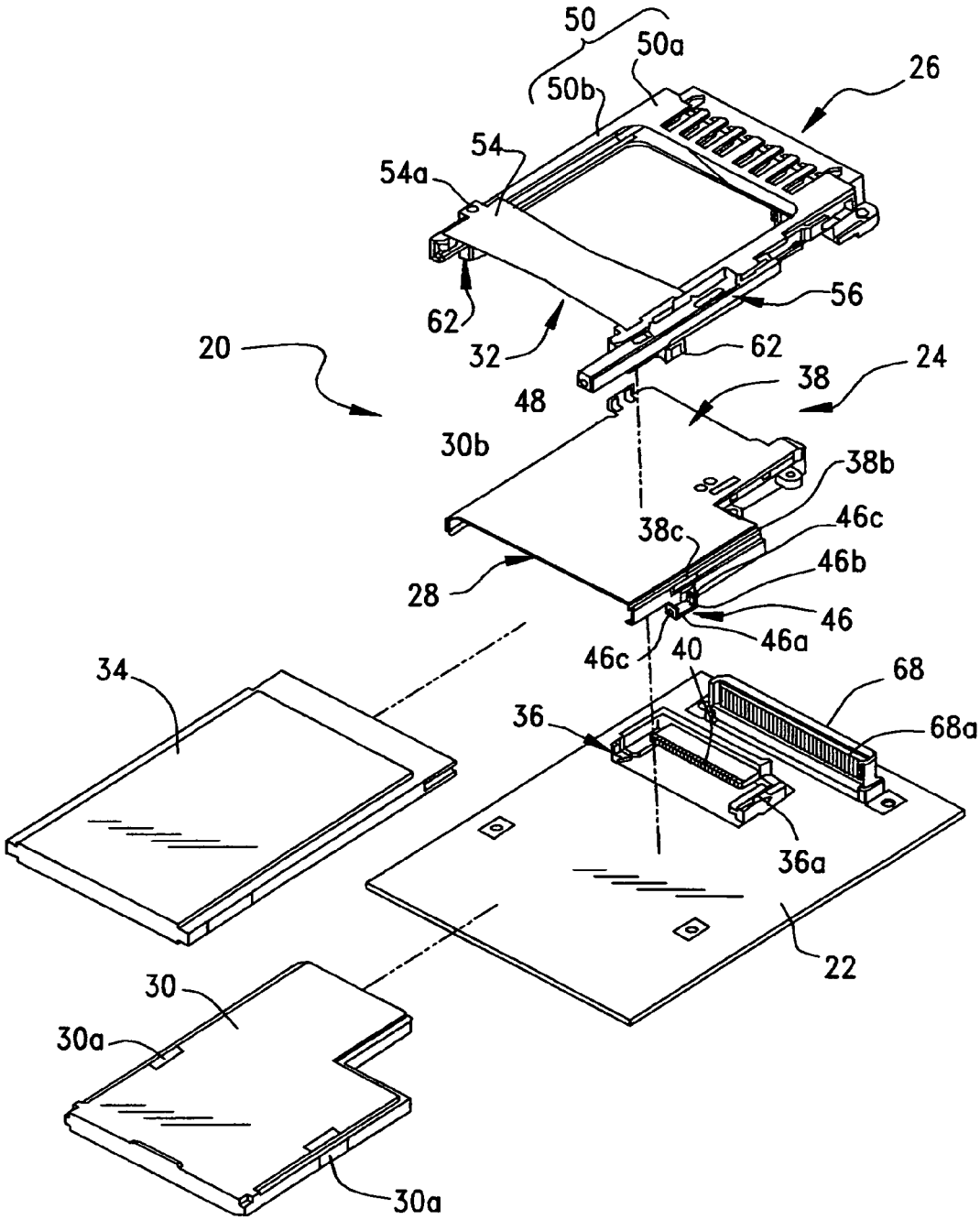
FIG. 2 is an exploded, top perspective view of a memory card connector assembly according to the invention.

Referring to the drawings in greater detail, and first to FIG. 2, the invention is embodied in a memory card connector assembly, generally designated 20, for mounting on a printed circuit board 22. The assembly includes a first or bottom memory card connector, generally designated 24, and a second or top memory card connector, generally designated 26. Bottom connector 24 defines a bottom card-receiving space, generally designated 28, for receiving a first or bottom memory card 30. Top connector 26 has a top card-receiving space, generally designated 32, for receiving a second or top memory card 34.

Generally, top connector 26 is mounted over the top of bottom connector 24. The two connectors are substantially independent of each other and either connector can be replaced with still another connector for receiving a different type of memory card. In other words, assembly 20 can be considered a modular design which includes plural connector modules 24 and 26.

With those understandings, and referring to FIGS. 2A–3A in conjunction with FIG. 2, bottom connector 24 has a housing means which includes a dielectric body, generally designated 36 in FIG. 2, and a metal shielding cover, generally designated 38. The dielectric body is mounted on printed circuit board 22 and includes a plurality of conductive terminals 40 for electrically connecting appropriate contacts on memory card 30 to appropriate circuit traces on the printed circuit board. An eject mechanism, generally designated 42, includes a guiding housing, generally designated 44, which is mounted at an inner end of dielectric body 36.

Metal shielding cover 38 of bottom connector 24 includes a top wall 38*a* and a pair of depending side walls 38*b*. The cover defines the top of the bottom card-receiving space 28 and, in essence, is located to separate the top and bottom card-receiving spaces 32 and 28, respectively. The metal shielding cover may be stamped and formed of conductive sheet metal material, and side walls 38*b* of the cover have inwardly bent grounding fingers 38*c* for engaging ground contacts 38*a* (FIG. 2) at opposite edges of memory card 30.

Figure 2A:
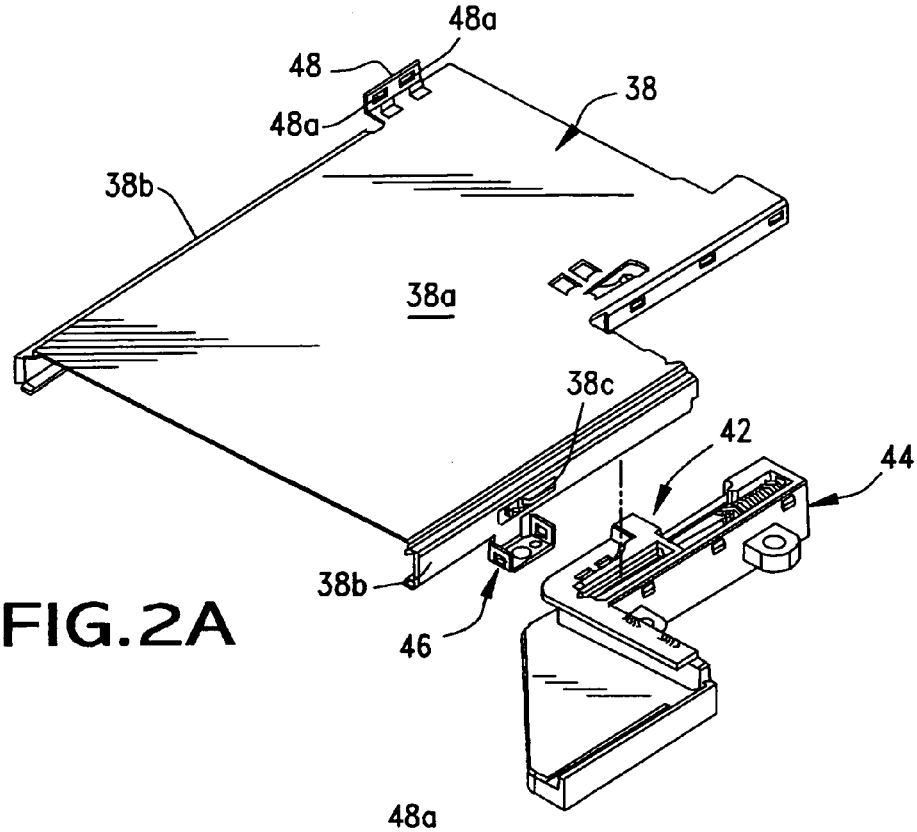
FIG. 2A is an exploded, top perspective view of the metal shielding cover and eject mechanism of the bottom connector of the assembly.

The metal shielding cover 38 has a pair of mounting portions, generally designated 46, at opposite sides thereof. As best seen in FIG. 2A, each mounting portion 46 is generally U-shaped to define a saddle for receiving a complementary mounting portion of top connector 26 as described hereinafter. Each mounting portion 46 has a fastener-receiving hole 46*a* in the bottom thereof, an orienting hole 46*b* also in the bottom thereof, and latch holes 46*c* in opposite sides thereof. All of these holes are operatively associated with various components of the mounting portions of top connector 26, as will be described hereinafter. An upwardly projecting latching flange 48 is formed at one side of cover 38 and includes a pair of latch apertures 48*a*.

Figure 3A:
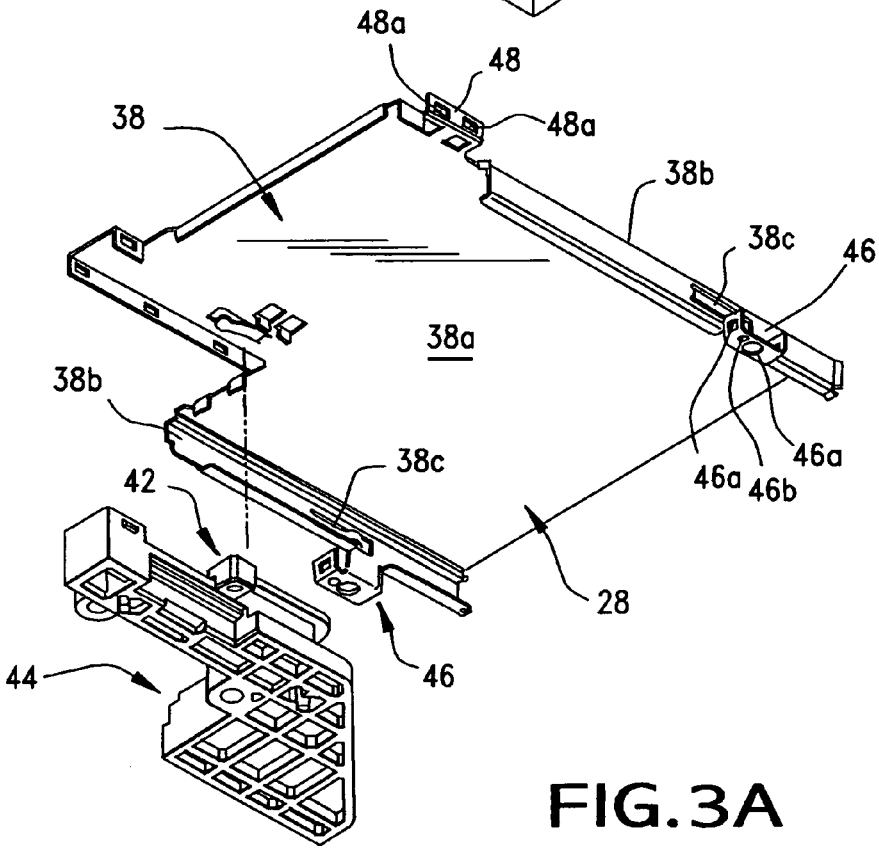
FIG. 3A is a bottom perspective view of the components in FIG. 2A.
Figure 3:
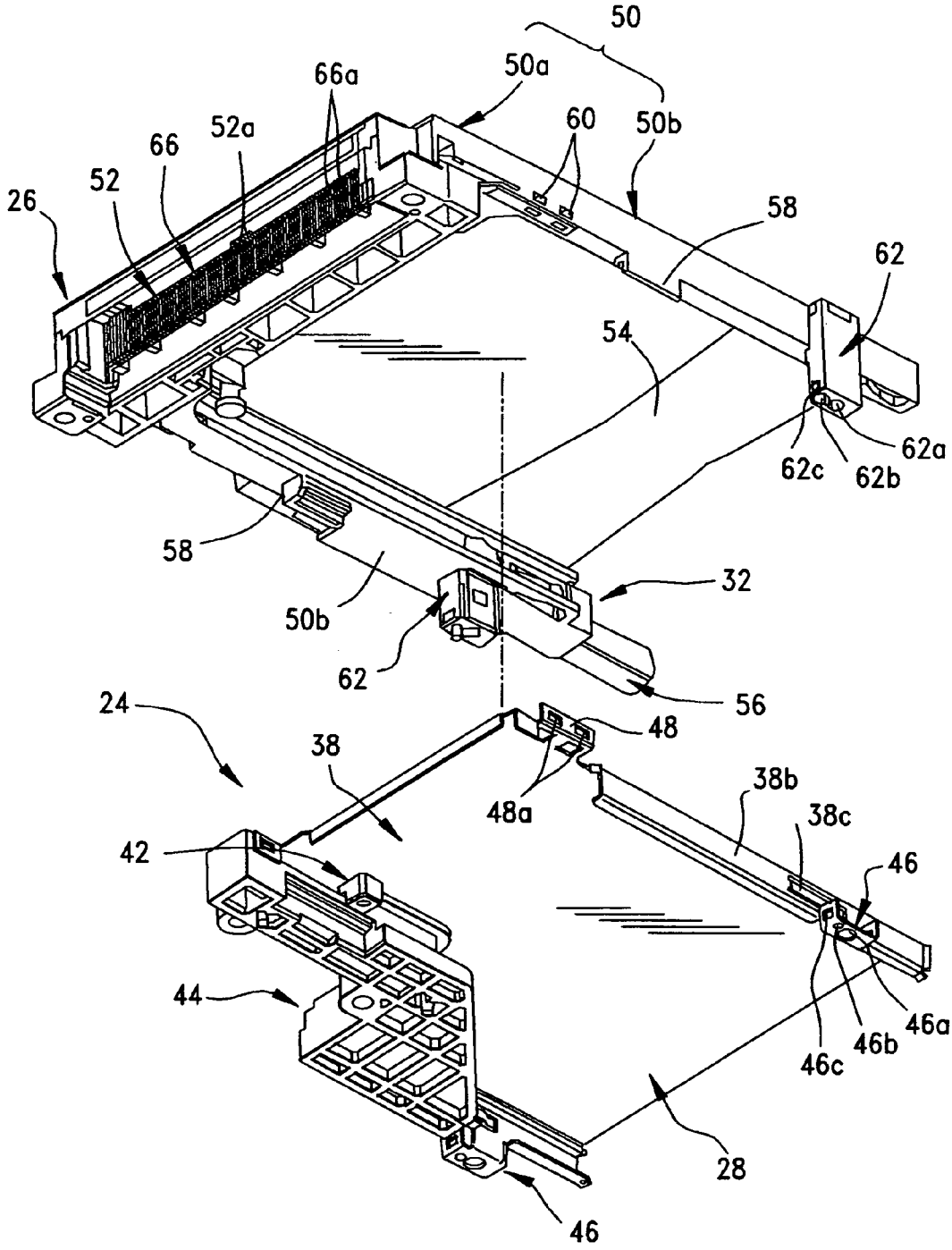
FIG. 3 is a bottom perspective view of portions of the housing means of the two connectors of the assembly.

Referring to FIG. 3 in conjunction with FIG. 2, top connector 26 includes a housing means 50 which is generally U-shaped and includes a rear terminal-mounting section 50*a* and a pair of side wall sections 50*b* extending forwardly from opposite ends of the rear section. A plurality of conductive terminals 52 (FIG. 3) are mounted on rear section 50*a* of the housing. The terminals electrically connect appropriate contacts on top memory card 34 with appropriate circuit traces on printed circuit board 22. A shielding plate 54 spans side wall sections 50*b* near the front ends thereof. A card eject mechanism, generally designated 56, is mounted along one side wall section 50*b* of the housing. As seen in FIG. 3, a pair of positioning blocks 58 project downwardly from side wall sections 50*b* for engaging the outsides of side walls 38*b* of the metal shielding cover to properly position housing 50 over the cover. The entire housing, including rear section 50*a*, side wall sections 50*d* and positioning blocks 58 may be a one-piece structure unitarily molded of dielectric material such as plastic or the like. Also as seen in FIG. 3, a pair of latch bosses 60 project outwardly from each side wall section 50*b* for latching engagement within latch apertures 48*a* of latching flanges 48 of the metal shielding cover 38 of the bottom connector.

As best seen in FIG. 3, a mounting portion, generally designated 62, is formed on each side wall section 50*b* of housing 50 of the top connector and depends downwardly for interengagement within a respective mounting portion 46 of the bottom connector. More particularly, each mounting portion 62 is a post-like member which seats within a respective one of the saddle-like, generally U-shaped mounting portions 46 of the bottom connector. Each mounting portion 62 has a fastener-receiving hole 62*a* which extends downwardly therethrough, along with an orienting post 62*b* which projects downwardly therefrom, and a pair of latch bosses 62*c* which project outwardly from opposite sides thereof.

Figure 4:
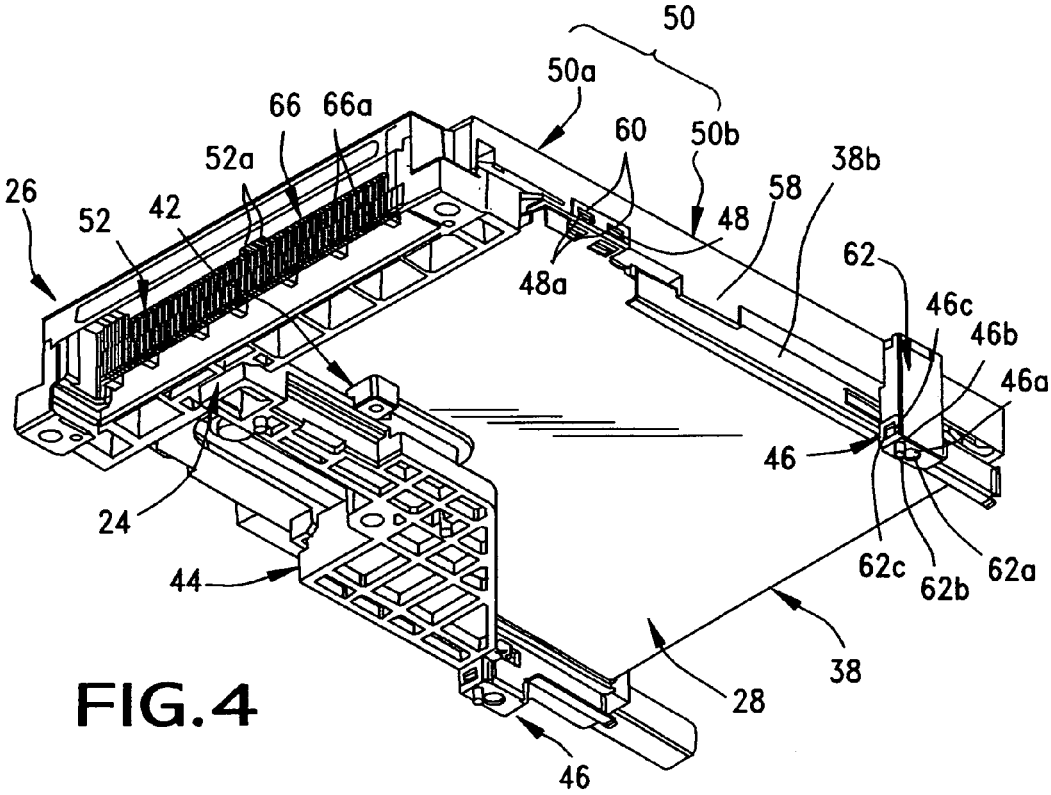
FIG. 4 is a bottom perspective view of the components in FIG. 3, juxtaposed one on top of the other.

FIG. 4 is a depiction of housing 50 of top connector 26 mounted over the top of shielding cover 38 of bottom connector 24. This depiction best shows one of the post-like mounting portions 62 of the top connector positioned within one of the saddle-like mounting portions 46 of the bottom connector. When so positioned, the fastener-receiving hole 62*a* of mounting portion 62 is aligned with the fastener-receiving hole 46*a* of mounting portion 46. Orienting post 62*b* of mounting portion 62 projects into orienting hole 46*b* of mounting portion 46. Latch bosses 62*c* of mounting portion 62 snap into latching engagement within latch holes 46*c* of mounting portion 46. Therefore, the interengagements between the two mounting portions 46 of the bottom connector and mounting portions 62 of the top connector temporarily hold the major portions of the two connectors in assembled condition. Different connectors can be interchanged with connectors 24 and/or 26 for receiving further, different types of memory cards simply by employing common mounting portions 46 and/or 62.

Figure 5:
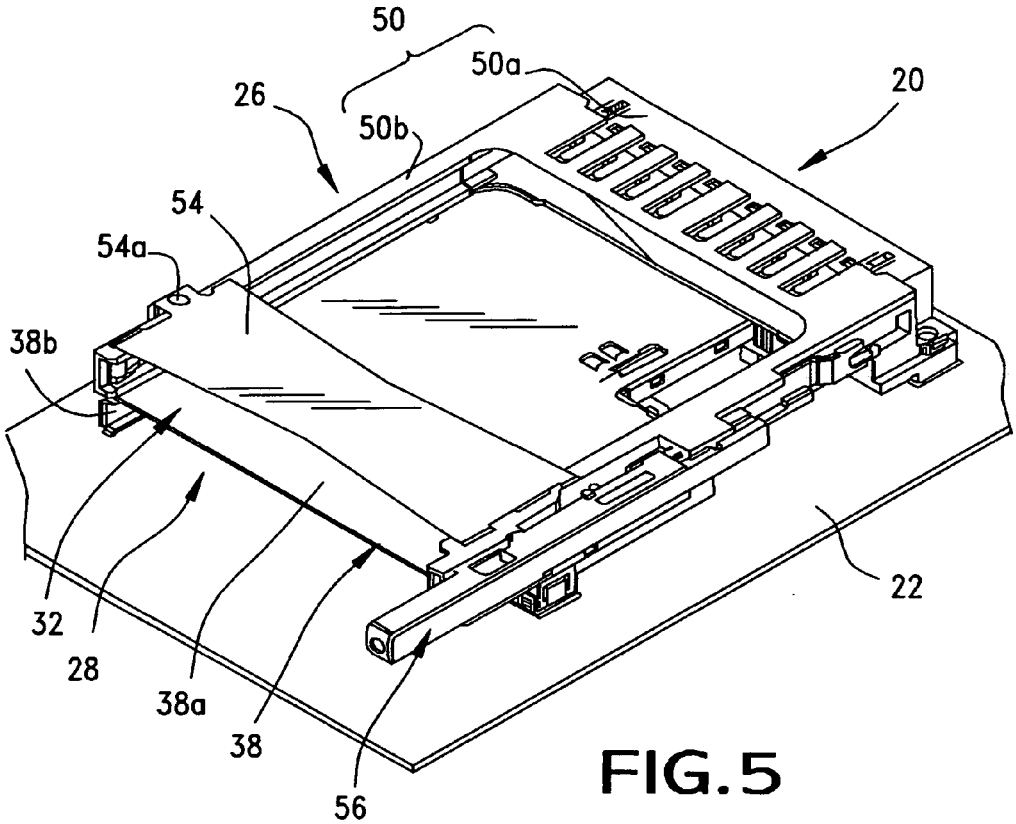
FIG. 5 is a top perspective view of the connector assembly mounted on the printed circuit board.
Figure 6:
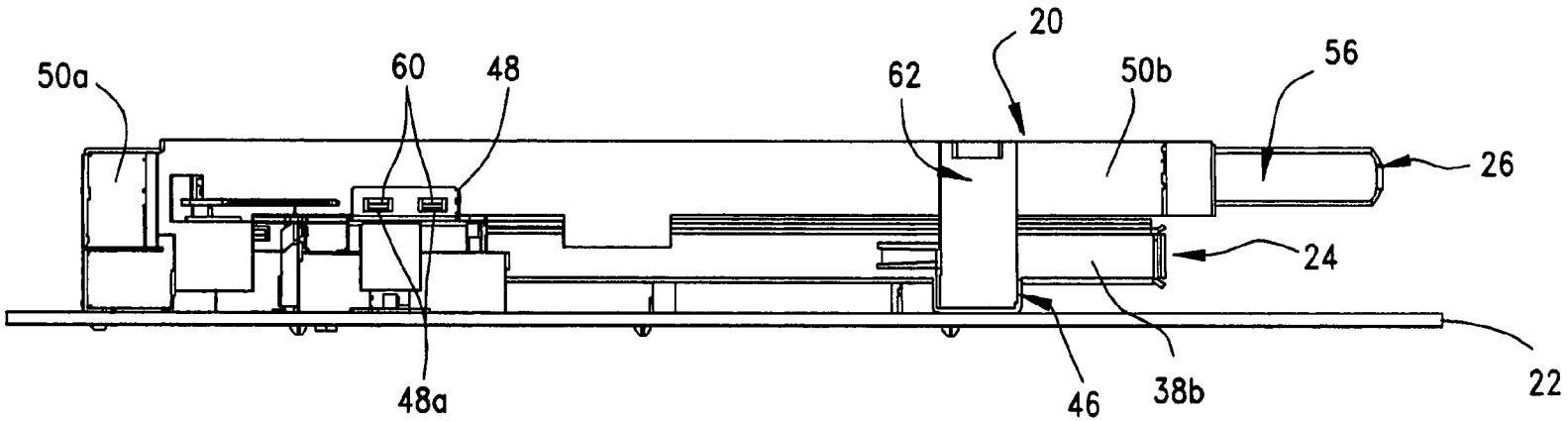
FIG. 6 is a side elevational view looking toward the left-hand side of FIG. 5.

FIGS. 5 and 6 show the assembly of FIG. 4 mounted on printed circuit board 22. In mounting the assembly to the circuit board, fasteners (not shown) are inserted through the aligned fastener-receiving holes 62*a* and 46*a* in mounting portions 62 and 46, respectively. To that end, shielding plate 54 has apertures 54*a* (one of which is not visible in the drawings) for receiving the fasteners therethrough. FIG. 5 clearly shows how top wall 38*a* of the metal shielding cover 38 separates or divides the bottom card-receiving space 28 from the top card-receiving space 32 for receiving memory card connectors 30 and 34, respectively. The fasteners pass through holes 46*a* in the metal shielding cover and then through holes 36*a* (FIG. 2) in dielectric body 36.

There are various systems for electrically connecting terminals 52 of top connector 26 to printed circuit board 22. FIGS. 3 and 4 show that terminals 52 have tail portions 52*a* bent downwardly therefrom. These tail portions could extend all the way down past bottom connector 24 and be connected to the circuit traces on the printed circuit board. However, the embodiment of FIGS. 3 and 4 show that an auxiliary circuit board, generally designated 66, includes a plurality of conductors 66*a* for connection, as by soldering, to tail portions 52*a* of terminals 52. The auxiliary circuit board, in turn, is inserted into an auxiliary connector 68 (FIG. 2) mounted on printed circuit board 22. Auxiliary connector 68 includes a plurality of terminals 68*a* for connection to appropriate circuit traces on the circuit board.

Figure 7:
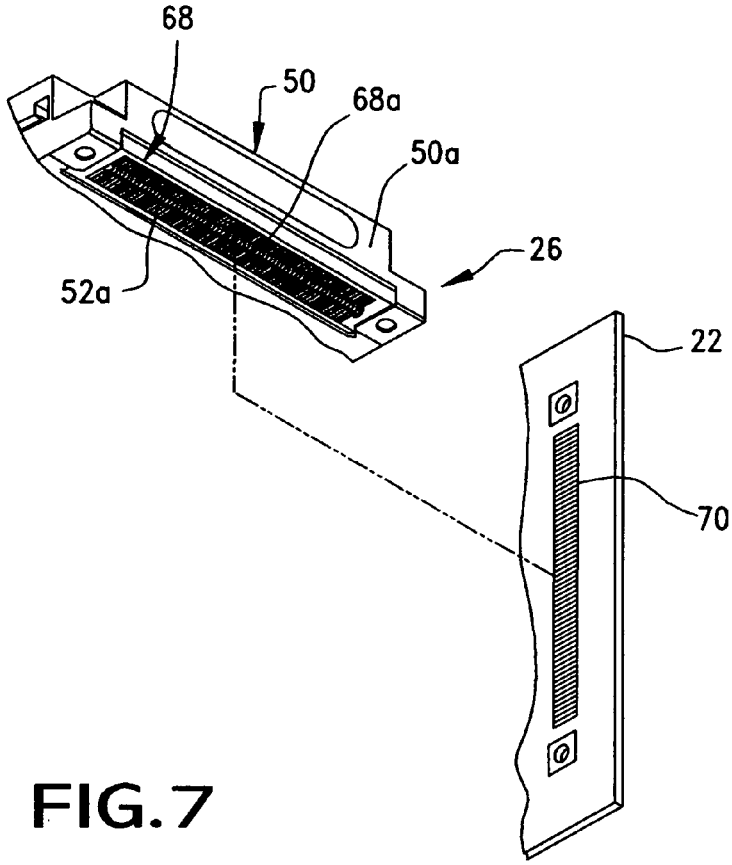
FIG. 7 is a fragmented perspective view of a second embodiment of the invention for electrically connecting the top connector of the assembly to the printed circuit board.

As stated above, tail portions 52*a* of terminals 52 can extend all the way down into direct connection to the circuit traces on printed circuit board 22. Accordingly, FIG. 7 shows a guiding board 68 mounted beneath rear section 50*a* of housing 50 of top connector 26. The guiding board has a plurality of terminal-receiving passages 68*a* for receiving tail portions 52 of terminals 52. The tail portions then can be connected directly to circuit traces 70 on the printed circuit board.

Figure 8:
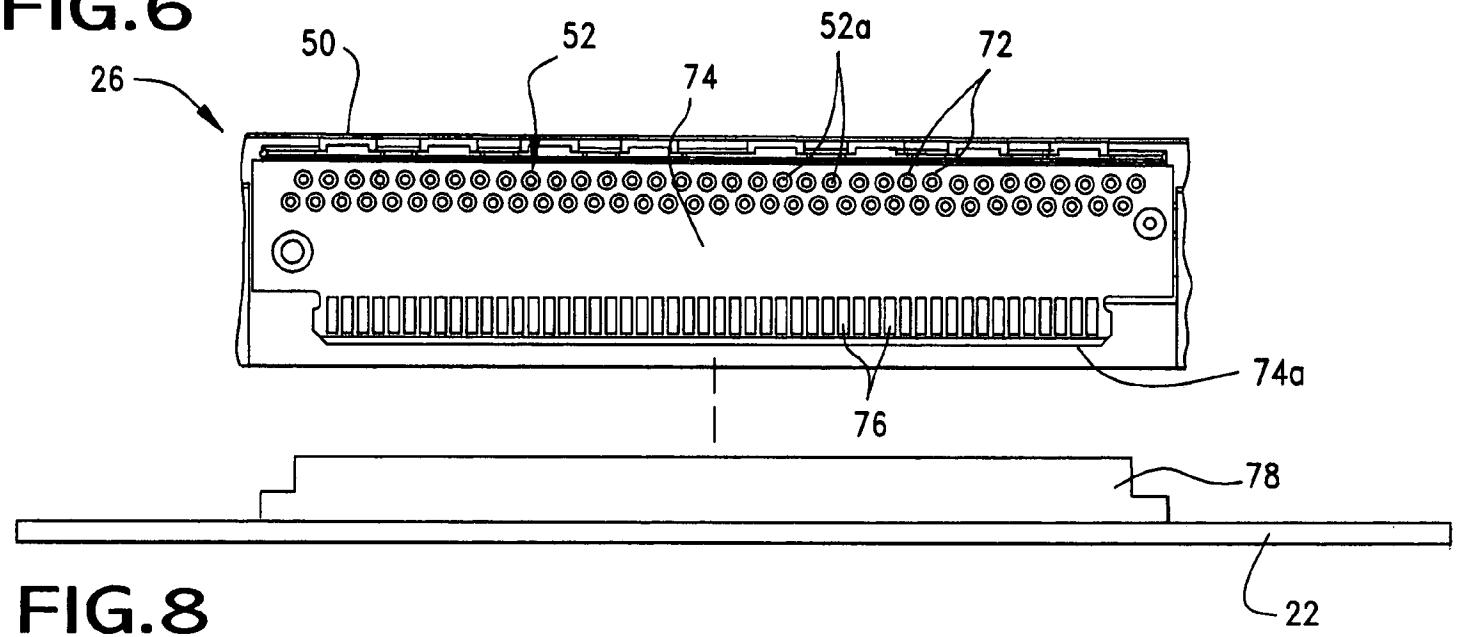
FIG. 8 is an enlarged, rear elevational view of a third embodiment of the invention for electrically connecting the top connector to the printed circuit board.
Figure 9:
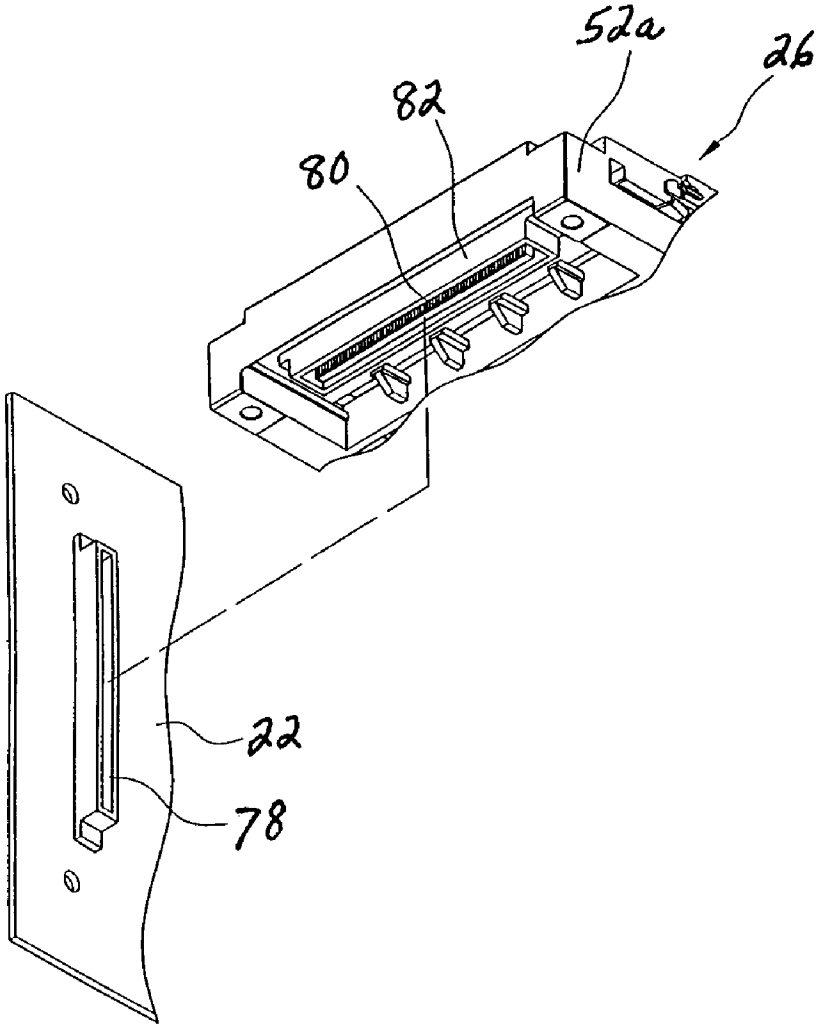

FIG. 8 shows another embodiment of the invention wherein tail portions 52*a* of terminals 52 are pin-like members and extend through holes 72 in an auxiliary circuit board 74. The tail portions are electrically coupled through circuit traces (not shown) on the auxiliary circuit board to a plurality of terminal portions 76 which engage appropriate terminals within a header connector 78 mounted on printed circuit board 22. Specifically, terminal portions 76 are deposited on an edge or tongue 74*a* of auxiliary circuit board 74, and the tongue is inserted into header connector 78 to electrically connect terminals 52 to circuit board 22.

Figure 9:
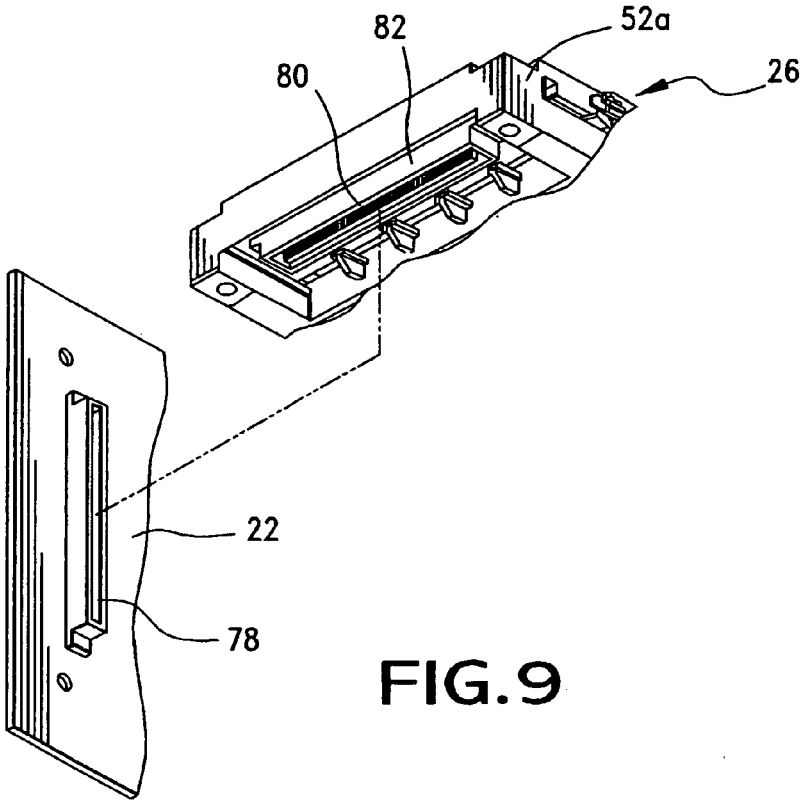
FIG. 9 is a fragmented perspective view of a fourth embodiment of the invention for electrically connecting the top connector to the printed circuit board.

Finally, FIG. 9 shows an embodiment wherein terminals 52 are electrically connected to a plurality of terminals 80 of an auxiliary connector 82 mounted at the bottom of the rear terminal-mounting section 52*a* of housing 50 of top connector 26. Auxiliary connector 82 is mated with header connector 78 on printed circuit board 22 to electrically connect terminals 52 to the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A memory card connector assembly for mounting on a printed circuit board, comprising:

a first memory card connector for mounting on the circuit board and including housing means defining a bottom card-receiving space for receiving a first memory card, along with a plurality of terminals for electrically connecting appropriate contacts on the memory card to the circuit board;

a second memory card connector for mounting over the top of the first connector and including housing means defining a top card-receiving space for receiving a second memory card, along with a plurality of terminals for electrically connecting appropriate contacts on the second memory card to the circuit board; and said first and second memory card connectors including respectively integrally formed aligned mounting portions for mounting the connectors on the circuit board, the aligned mounting portion for the first memory card connector being U-shaped to define a saddle for receiving the aligned mounting portion for the second memory card connector.

2. The memory card connector assembly of claim 1 wherein the housing means of said first memory card connector includes a metal shielding cover defining the top of said bottom card-receiving space.

3. The memory card connector assembly of claim 2 wherein said metal shielding cover is located to separate the top and bottom card-receiving spaces.

4. The memory card connector assembly of claim 1 wherein said first memory card connector includes a dielectric body mounting its respective terminals.

5. The memory card connector assembly of claim 1 wherein said first memory card connector includes a card eject mechanism.

6. The memory card connector assembly of claim 1 wherein said second memory card connector includes a card eject mechanism.

7. The memory card connector assembly of claim 6 wherein said first memory card connector includes a card eject mechanism separate and independent from the card eject mechanism of the second connector.

8. The memory card connector assembly of claim 1 wherein said second memory card connector includes a dielectric housing mounting the terminals of the second connector, and including an auxiliary connector mounted on the printed circuit board, the auxiliary connector including terminals for engaging the terminals of the second connector.

9. The memory card connector assembly of claim 1 wherein the housing means of said first connector include a dielectric body mounting its respective terminals along with a metal shielding cover defining the top of said bottom card-receiving space.

10. A memory card connector assembly for mounting on a printed circuit board, comprising:

a first memory card connector for mounting on the circuit board and including housing means defining a bottom card-receiving space for receiving a first memory card, said housing means including a dielectric body mounting a plurality of first terminals for electrically connecting appropriate contacts on the first memory card to the circuit board and a metal shielding cover defining the top of the bottom card-receiving space;

a second memory card connector for mounting over the top of the first connector and including a dielectric housing defining a top card-receiving space for receiving a second memory card, the housing mounting a plurality of terminals for electrically connecting appropriate contacts on the second memory card to the circuit board; and the metal shielding cover of said first memory card connector and the dielectric housing of said second memory card connector include respectively integrally formed aligned mounting portions for mounting the connectors on the circuit board, the alignment mounting portion for the metal shielding cover of the first memory card connector being U-shaped to define a saddle for receiving the alignment mounting portion of the dielectric housing of the second memory card connector.

11. The memory card connector assembly of claim 10 wherein said metal shielding cover of the first memory card connector is located to separate the top and bottom card-receiving spaces.

12. The memory card connector assembly of claim 10 wherein said first memory card connector includes a card eject mechanism.

13. The memory card connector assembly of claim 10 wherein said second memory card connector includes a card eject mechanism.

14. The memory card connector assembly of claim 13 wherein said first memory card connector includes a card eject mechanism separate and independent from the card eject mechanism of the second connector.

15. The memory card connector assembly of claim 10, including an auxiliary connector mounted on the printed circuit board, the auxiliary connector including terminals for engaging the terminals of the second connector.

* * * * *